US005150548A

United States Patent [19]

Boquet et al.

[11] Patent Number: 5,150,548

[45] Date of Patent: Sep. 29, 1992

[54] METHOD FOR TREATING THE SURFACE OF AN ARTICLE WITH SOLID PARTICLES

[75] Inventors: Jean P. M. Boquet, Le Perray en Yvelines; Daniel J. A. Ermisse, Pecqueuse; Gabriel J. L. Cattin, Pont de Roide, all of France

[73] Assignees: Bertin & Cie, Plaisir Cedex; Cattin'Air SA, Pont de Roide, both of France

[21] Appl. No.: 724,853

[22] Filed: Jul. 2, 1991

Related U.S. Application Data

[62] Division of Ser. No. 912,108, Sep. 29, 1986, Pat. No. 5,027,558.

[30] Foreign Application Priority Data

Sep. 27, 1985 [FR] France ..... 85 14335

[51] Int. Cl.[5] ..... B24B 1/00; B24B 9/00; B24B 31/00

[52] U.S. Cl. ..... 51/313; 51/6; 51/17; 51/316

[58] Field of Search ..... 51/6, 7, 17, 316, 317, 51/313, 315, 410, 426; 134/119, 164

[56] References Cited

U.S. PATENT DOCUMENTS

| | | | |
|---|---|---|---|
| Re. 33,542 | 2/1991 | Musschoot | 51/7 |
| 2,425,640 | 8/1947 | Pruitt et al. | 51/7 |
| 4,314,856 | 2/1982 | Steimel | 51/316 |

FOREIGN PATENT DOCUMENTS

| | | |
|---|---|---|
| 2520399 | 8/1976 | Fed. Rep. of Germany . |
| 1057952 | 3/1954 | France . |
| 1510483 | 12/1967 | France . |
| 184666 | 5/1981 | Japan . |
| 82669A | 5/1983 | Japan . |
| 47156A | 3/1984 | Japan . |
| 726204 | 1/1953 | United Kingdom . |
| 821992 | 10/1959 | United Kingdom . |
| 1067656 | 5/1967 | United Kingdom . |

OTHER PUBLICATIONS

Russian Engineering Journal, 1323 Vol. 11-1973, pp. 44-45, Rarskii et al., "Better Productivity in Vibroabrasive Machining".

*Primary Examiner*—Bruce M. Kisliuk
*Assistant Examiner*—Bo Bounkong
*Attorney, Agent, or Firm*—Breiner & Breiner

[57] ABSTRACT

The method disclosed is for treating an article, i.e., polishing an article, of the type with a rotating vessel where the article to be treated is fastened in relation to the vessel. To enable the article to be treated to be placed in position without the need to remove the particles from the vessel, the article is moved between a loading and unloading position, where the article is outside the mass of particles, and a working position, where it is subjected to the action of the particles to polish and strip pieces of furniture.

3 Claims, 2 Drawing Sheets

METHOD FOR TREATING THE SURFACE OF AN ARTICLE WITH SOLID PARTICLES

This is a division of application Ser. No. 06/912,108 filed Sep. 29, 1986 now U.S. Pat. No. 5,027,558.

The present invention relates to a method for treating the surface of an article with solid particles.

BACKGROUND OF INVENTION

The treatment of the surface of an article with more or less abrasive solid particles has been known for a long time, either for descaling or for improving the state of the surface, for example for obtaining a matt or shiny appearance.

When the article to be treated is metallic, then a method known as the "drum" method is usually employed, according to which the article is placed free in a mass of particles contained in a receptacle and this receptacle is driven, for example in rotation around a horizontal or inclined axis passing through it, so as to stir the article and the particles together.

This method cannot be used when the article to be treated is markedly lower in density than the mass of particles, because it then tends to adopt a position above this mass.

It is known, in this case, to immobilize the article in relation to the receptacle so that the solid particles may successively touch it as the receptable rotates. FR-A-1,057,952 describes a device comprising receptacles with a vertical axis, into which the articles carried by a vertical sliding rod which is placed above them are lowered. JP-A-5,882,669 describes a piece of apparatus of the same kind, but in which the vessel has an axis which is inclined at 30° to 45° to the vertical, its upper end being open and provided with a collar to retain the particles and in which the article is maintained by virtue of a vertical sliding rod, in the lowest part of the volume of the receptacle.

Devices of this kind cannot be adapted for the treatment of fragile articles such as pieces of furniture or parts of pieces of furniture, because problems arise when the article enters the mass of the solid particles; unless this is done very slowly, a considerable force is needed to push the article in, even when the receptacle is rotating, and the article runs the risk of being damaged.

The method generally employed consists in pouring the particles out of the receptacle while the article is introduced and then reintroducing these partices gradually into the receptacle, preferably while the latter rotates. These operations are slow and costly.

To give an idea of this, it may be stated that, to treat a chair or armchair frame, a mass of glass beads of the order of 1500 kg is generally employed.

In Application DE-A-2,520,399, it has been proposed to use a receptacle capable of switching from a vertical position, in which the article is above the mass of particles, to a horizontal position, in which the article is partially immersed in the mass. This system is bulky, and the tilting operation needs to be slow in order not to damage the article.

In Patent Application EP-A-0,084,483 it has been proposed to simplify the emptying and refilling operations of the receptacle by virtue of an auxiliary receptacle, concentric with the principal receptacle and integrally fastened thereto; the auxiliary receptacle communicates with the principal receptacle and makes it possible to place the particles aside when the article to be treated is placed in position and when it is removed. The device has the disadvantage of being bulky.

SUMMARY OF THE INVENTION

The purpose of the present invention is to provide a device of type indicated above, in which the operations of introducing and withdrawing the article to be treated are simple and quick, the device being, nevertheless, as small as possible in size.

To achieve this result, the invention provides a device for treating the surface of an article by contacts with solid particles, comprising:

- a vessel having an axis of symmetry oblique in relation to the horizontal, around which it can rotate, this vessel being capable of containing a quantity of solid particles filling the said vessel over more than one half of its volume and having, at its upper axial end, an opening of sufficient size to permit the passage of an article to treated, surrounded by a collar intended to retain the particles,
- a support capable of maintaining the article to be treated in a substantially fixed working position inside the vessel,
- means for driving the vessel in rotation on its axis, and
- means enabling the object to be moved parallel to the axis between the said working position and a loading or unloading position in which the article is outside the mass of particles, these means permitting movement of the article during the said rotation of the vessel on its axis, wherein:

- the means for moving the article between the working position and the loading and unloading position are capable of moving the article parallel to the axis of the vessel, and
- the means for driving the vessel in rotation are designed to cause the latter to rotate at a speed such that the solid particles driven by the walls of the vessel fall as a shower onto the article during its movement towards the working position.

Thus, by virtue of the fact that the article is introduced obliquely into the mass of the particles and as the latter is devoid of compactness, since it is falling as a shower, the introduction may be carried out rapidly and free from risk.

The support for the article preferably comprises a column having the same axis as the vessel, passing through the bottom of the vessel and capable of sliding axially through the bottom of the vessel, this column bearing means for clamping the article, and the means for moving the article are placed on the opposite side of the bottom of the vessel in relation to the clamping means.

This overcomes another disadvantage of the prior art, where the article to be treated is fixed to a support suspended above the vessel, which hampers the operations of fastening and removal of the article and complicates any mechanization of these operations.

BRIEF DESCRIPTION OF DRAWINGS

The invention will be set out in greater detail with the aid of a practical example illustrated by means of the figures. Among these.

DETAILED DESCRIPTION OF PREFERRED EMBODIMENT

Figure 1:
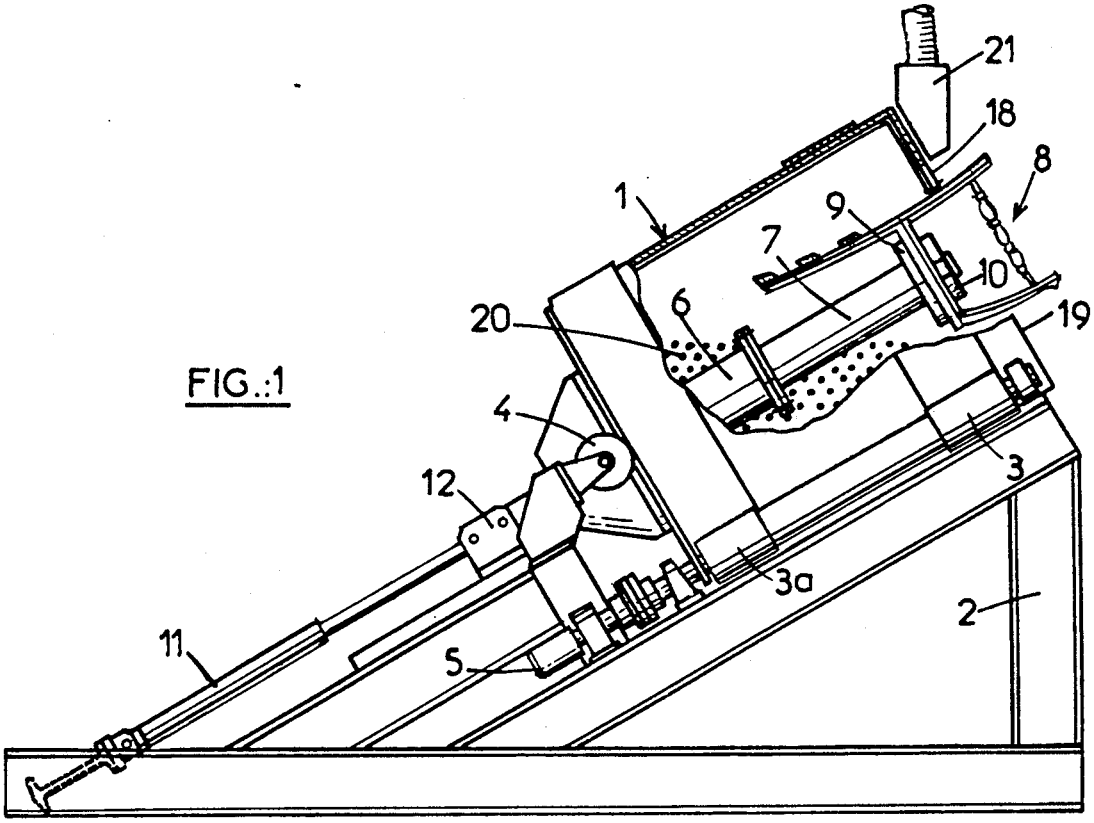
FIG. 1 is an elevation, partially sectioned, view of the device in a loading configuration.

The apparatus described in the figures is intended for polishing and stripping wooden seats such as chairs, armchairs, stools or settee components.

A vessel 1, of cylindrical shape, is carried by a chassis 2, so as to be capable of rotating around its axis, the latter being inclined at approximately 30° to the horizontal. For this purpose, the chassis carries two series of rollers 3, 3*a* parallel to the axis of the vessel and arranged on each side of the latter's vertical plane of symmetry. These rollers support the vessel, while other rollers 4, whose axis is perpendicular to that of the vessel and which are arranged below the latter, prevent it from moving down along the chassis under the effect of its weight. A motor 5 drives some of the rollers 3, 3*a* in rotation and as a result also drives the vessel itself in rotation around its axis.

A tubular guide 6 passes axially through the bottom of the vessel, serving as a guide for a cylindrical column 7 which forms part of the seat support and which can slide inside the guide 6.

At its upper end, the column 7 travels forward beyond the guide 6 and carries a device for holding a seat 8. This device comprises a fixed annular plate 9, integrally fastened to the column 7, and a movable assembly 10 driven by a jack and capable of clamping the crossbars of the seat between itself and the plate 9.

Figure 3:
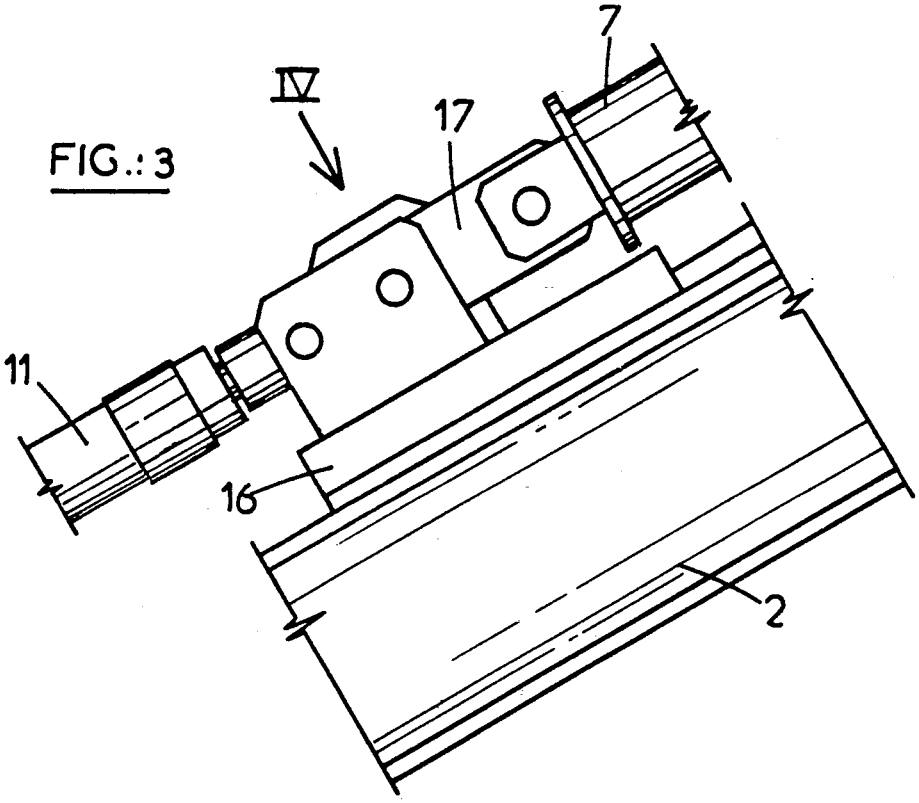
FIG. 3 is an enlarged view of a part of FIGS. 1 and 2.
Figure 4:
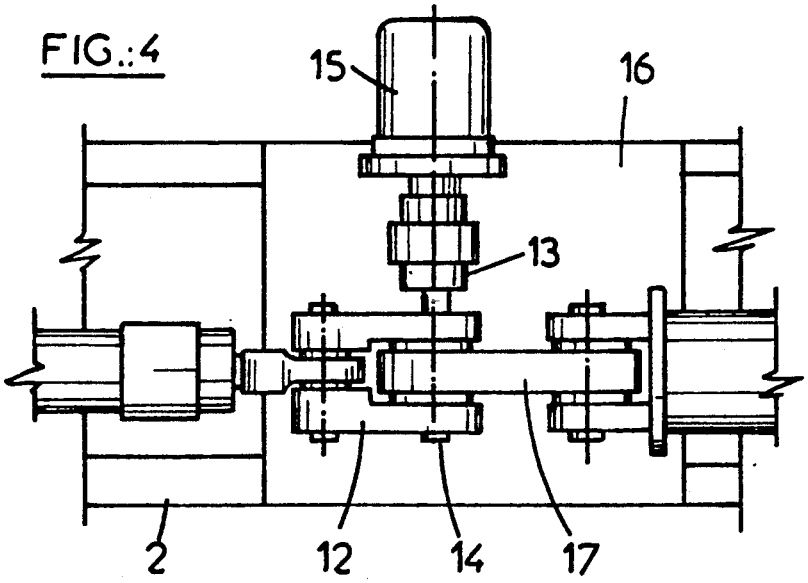
FIG. 4 is a view in the direction of the arrow IV of FIG. 3.

The attachment between the jack 11 and the chassis 2 is ensured by an articulation of a traditional type. The other end of the jack is also connected by means of an articulation of a traditional type to a truck 16 mounted on slides fastened to the chassis 2, supporting an eccentric device connected to the column 7, which can be seen more clearly in FIGS. 3 and 4. This device comprises a clevis 12, integrally fastened to the truck 16 and a pushrod 17 articulated to the column 7.

A shaft 14 passes both through the clevis 12 and the pushrod 17. It is driven in rotation by a motor 15, by means of a coupling 13. In the region of the pushrod 17, this shaft has an eccentric part so that when the motor rotates it imparts an oscillating movement to the column 7 by means of the pushrod 17, at a frequency which depends on the speed of rotation of the motor. The oscillations in the direction of the axis of column 7 are transmitted to the article 8.

Alternately, the vibrational movement may be produced directly by the jack 11 by imparting periodic pulses to the latter's working fluid.

At its opposite end, that is to say at its upper end, the vessel is closed only partially and has a circular central opening 18, of sufficient size to permit the passage of one of the pieces of furniture which it is intended to treat. This central opening is surrounded by a collar 19 intended to retain the glass beads 20 which are held in the vessel and which are intended for the required processing. An extraction hood 21 is used to trap the dust escaping through the opening 18. This hood is fixed, that is to say it is not driven in rotation by the vessel 1.

FIG. 1 shows the loading position: in this position the jack 11 is in an extended position, the column 7 is moved forward along the axis of the vessel, so that the device for attaching a piece of furniture 8 is situated close to the opening 18. In this configuration, it is easy for an operator to place a piece of furniture between the plate 9 and the movable assembly 10, which is then moved back to enable the piece of furniture to be placed in position. During this operation the vessel is stationary.

Figure 2:
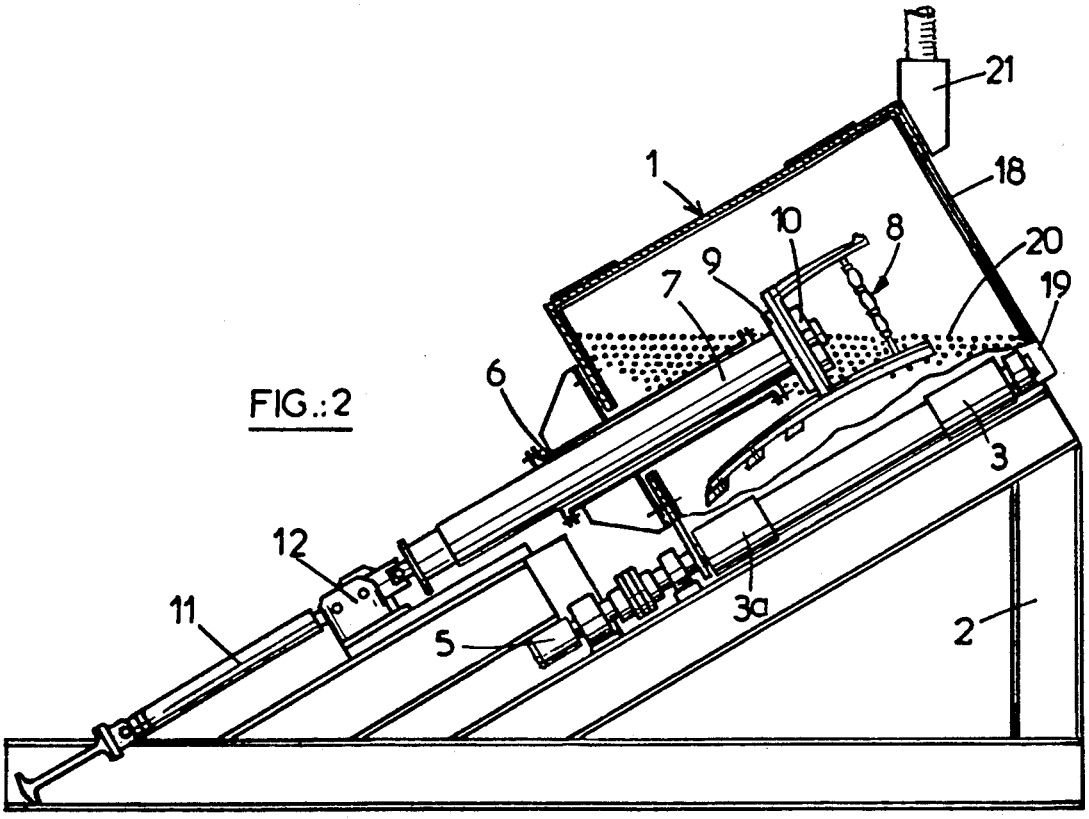
FIG. 2 is a sectional view of the same device in a working configuration.

FIG. 2 shows the equipment in a working configuration; the jack 11 is then in a retracted position and the seat then occupies substantially the center of the vessel. I: will be noted that in the loading position the mass of beads 20 is still in place in the latter. The switch from the loading position to the working position is, nevertheless, made without difficulty provided that the piece of furniture is moved gradually towards the interior of the vessel by means of the jack 11, while the vessel, and consequently the beads 20, are in motion. The latter are driven by the vessel in rotation and fall back in a shower into the latter, especially onto the article to be treated. The work of surface treatment thus begins even before the end of the movement into the working position. In FIG. 2, the upper level of the mass of beads 20 has been shown as a horizontal line. It should be noted that, during the operation, there is no stable position of the free surface of the mass of beads, since the latter act on all the parts of the piece of furniture, in contrast to what might have been expected when looking at FIG. 2.

The slope of the axis of the vessel is not critical; however, if this slope is too low, then the vessel will need to be made longer to prevent the beads escaping by passing over the collar 19. If, on the other hand, the axis of the vessel is made to slope too steeply, the parts of the piece of furniture which will be situated close to the bottom run the risk of being treated too energetically compared with the parts of the piece of furniture situated on the opposite side. Trials have shown that a slope of the order of 30° is suitable for pieces of furniture such as chairs, armchairs, stools or settee components. So far as the vibration in the direction parallel to the axis is concerned, it has been found that a frequency of the order of 15 Hz with an amplitude of approximately 5 mm is suitable. The vessel rotates around itself at a speed of rotation of the order of 15 revolutions/minute, with reversal of the direction of rotation after a period of one to two and half minutes. It has been found that this speed, which ensures that the beads fall properly as a shower onto the article to be treated, is that best suited to the size of the vessel and to the nature of the particles. Adaptation of the conditions in each case lies within the skill of the specialist. An excessively slow speed moves the particles in an insufficient manner, whereas an excessively high speed forces them against the walls owing to the action of the centrifugal force. It has been found that the device according to the invention yields good quality results, and that it is easy to load with minimum loss of time and minimum fatigue. It will also be noted that the simplicity of the positioning operations and particularly the fact that there is no door to be opened in order to introduce the piece of furniture into the vessel, enable these operations to be readily automated. In this case, a robot arm introduces the piece of furniture into the vessel and switches actuate the clamping members once the piece of furniture is placed in position.

We claim:

1. A method for treating a surface of an article by contacting said surface with solid particles, comprising the steps of:

providing a vessel having an axis of symmetry oblique in relation to the horizontal around which it can rotate, said vessel having walls and an upper axial end with an opening of sufficient size to permit the passage of an article to be treated, filling said vessel with solid particles substantially to a level such that when said vessel is in said oblique position, said particles are retained in said vessel by the walls of the vessel, driving said vessel in rotation on the axis at a speed so that the solid particles are caused to be driven by the walls of the vessel and fall as a shower inside the vessel, moving said article from a load/unload position, where the article is outside the solid particles, to a working position inside the vessel, said movement being done while the vessel rotates and while the particles fall as a shower onto said article, the article being moved obliquely in relation to the horizontal and parallel to the axis of the vessel, maintaining the article substantially fixed in said working position during treatment, and moving back said article to said load/unload position after treatment.

2. The method of claim 1 wherein the axis of the vessel is inclined by approximately 30° to the horizontal.

3. The method of claim 2 comprising the step of introducing vibratory movement to said article.

* * * * *